US010865989B2

(12) United States Patent
Sadasivuni

(10) Patent No.: US 10,865,989 B2
(45) Date of Patent: Dec. 15, 2020

(54) COMBUSTOR ARRANGEMENT HAVING ARRANGED IN AN UPSTREAM TO DOWNSTREAM FLOW SEQUENCE A RADIAL SWIRLER, PRE-CHAMBER WITH A CONVERGENT PORTION AND A COMBUSTION CHAMBER

(71) Applicant: Siemens Aktiengesellschaft, Munich (DE)

(72) Inventor: Suresh Sadasivuni, Lincoln (GB)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 265 days.

(21) Appl. No.: 15/572,812

(22) PCT Filed: May 24, 2016

(86) PCT No.: PCT/EP2016/061700

§ 371 (c)(1),
(2) Date: Nov. 9, 2017

(87) PCT Pub. No.: WO2016/193068

PCT Pub. Date: Dec. 8, 2016

(65) Prior Publication Data

US 2018/0135859 A1 May 17, 2018

(30) Foreign Application Priority Data

May 29, 2015 (EP) ..... 15169977

(51) Int. Cl.
*F23R 3/14* (2006.01)
*F23R 3/28* (2006.01)

(52) U.S. Cl.
CPC ..... *F23R 3/286* (2013.01); *F23R 3/14* (2013.01); *F23C 2900/03005* (2013.01); *F23C 2900/9901* (2013.01); *F23R 2900/00002* (2013.01)

(58) Field of Classification Search
CPC .... F23R 3/12; F23R 3/14; F23R 3/286; F23D 14/02; F23D 2900/14021;
(Continued)

(56) References Cited

U.S. PATENT DOCUMENTS 3,958,413 A 5/1976 Cornelius et al.
4,842,197 A * 6/1989 Simon ..... F23C 7/002 239/400

(Continued)

FOREIGN PATENT DOCUMENTS

EP 0747635 A2 12/1996
EP 1975513 A2 10/2008

(Continued)

OTHER PUBLICATIONS

International Search Report dated Aug. 3, 2016, for PCT/EP2016/061700.

(Continued)

*Primary Examiner* — William H Rodriguez

(57) ABSTRACT

A combustor for a gas turbine engine having a central axis about which is arranged in flow sequence a radial swirler, a pre-chamber partly defined by a wall and a combustion chamber. The radial swirler has a base plate having an annular array of vanes and fuel injectors arranged to direct an air/fuel mixture radially inwardly and tangentially to create a vortex that flows through the pre-chamber and into the combustion chamber. The pre-chamber has a portion which is convergent in a downstream direction.

15 Claims, 4 Drawing Sheets

(58) Field of Classification Search
CPC .... F23C 2900/03005; F23C 2900/9901; F23C 2900/00002
See application file for complete search history.

(56) References Cited

U.S. PATENT DOCUMENTS 5,060,867 A * 10/1991 Luxton ..... F23D 14/02 239/428.5
5,165,241 A * 11/1992 Joshi ..... F23R 3/14 60/737
5,417,070 A * 5/1995 Richardson ..... F23C 7/004 239/406
5,879,148 A 3/1999 Cheng et al.
6,212,870 B1 * 4/2001 Thompson ..... F23R 3/283 60/772
6,244,051 B1 * 6/2001 Zarzalis ..... F23R 3/14 60/743
6,381,964 B1 * 5/2002 Pritchard, Jr. ..... F23R 3/14 60/746
2002/0112480 A1 * 8/2002 McMillan ..... F23R 3/12 60/737
2003/0205048 A1 * 11/2003 Hellat ..... F23R 3/12 60/723
2004/0025508 A1 * 2/2004 Calvez ..... F23R 3/14 60/746
2005/0034444 A1 2/2005 Sanders
2005/0257530 A1 * 11/2005 Zupanc ..... F23R 3/14 60/776
2009/0139242 A1 * 6/2009 Senior ..... F23C 7/002 60/748
2010/0126176 A1 * 5/2010 Kim ..... F23R 3/14 60/748
2010/0175379 A1 * 7/2010 Liu ..... F02C 3/20 60/723
2010/0293953 A1 * 11/2010 Wilbraham ..... F23R 3/286 60/737
2011/0000216 A1 * 1/2011 Imamura ..... F23R 3/60 60/748
2011/0101131 A1 * 5/2011 Milosavljevic ..... F23R 3/286 239/399
2011/0138815 A1 * 6/2011 Headland ..... F23R 3/14 60/772
2011/0308155 A1 * 12/2011 Paskach ..... C10J 3/463 48/77
2012/0017595 A1 * 1/2012 Liu ..... F23D 14/02 60/737
2012/0042655 A1 * 2/2012 Lam ..... F23C 7/004 60/737
2012/0227407 A1 * 9/2012 Reiss ..... F23R 3/286 60/737
2014/0165585 A1 * 6/2014 Burd ..... F23R 3/12 60/776
2014/0174096 A1 * 6/2014 Milosavljevic ..... F02C 3/30 60/776
2015/0211734 A1 * 7/2015 Tsumagari ..... B01F 5/0065 431/354
2015/0300646 A1 * 10/2015 Biagioli ..... F23R 3/14 60/776
2016/0334104 A1 * 11/2016 Yang ..... F23R 3/286
2017/0009994 A1 * 1/2017 Buchanan ..... F23R 3/286
2017/0023251 A1 * 1/2017 Leparoux ..... F23R 3/12

FOREIGN PATENT DOCUMENTS

EP 2172709 A2 4/2010
EP 2629008 A1 8/2013
WO 0159369 A1 8/2001

OTHER PUBLICATIONS

EP Search Report and Opinion dated Nov. 13, 2015, for EP15169977.4.

* cited by examiner

COMBUSTOR ARRANGEMENT HAVING ARRANGED IN AN UPSTREAM TO DOWNSTREAM FLOW SEQUENCE A RADIAL SWIRLER, PRE-CHAMBER WITH A CONVERGENT PORTION AND A COMBUSTION CHAMBER

CROSS REFERENCE TO RELATED APPLICATIONS

This application is the US National Stage of International Application No. PCT/EP2016/061700 filed May 24, 2016, and claims the benefit thereof. The International Application claims the benefit of European Application No. EP15169977 filed May 29, 2015. All of the applications are incorporated by reference herein in their entirety.

FIELD OF INVENTION

The present invention relates to a combustor for a gas turbine and in particular a pre-chamber of the combustor.

BACKGROUND OF INVENTION

In a gas turbine Dry Low Emissions (DLE) combustion system, it is possible to burn a small amount, e.g. 5% by volume, of hydrogen with natural gas. However, the presence of hydrogen can cause the combustion flame to flashback into the pre-chamber and swirler. This is primarily due to the configuration of the radial swirler burner with main gas fuel injection in the radial swirler slots at two different locations. Aerodynamics in the central region of the combustor can include some reverse flow of the flame which can enhance the flame propagation back towards the swirler slots. Flow reversal and subsequent flashback is particularly apparent when hydrogen is present in a significant quantity in the fuel mixture because combusting hydrogen has higher flame speeds. Research in hydrogen flame stabilization showed that flames generated on hydrogen fuel needs to be arrested or blocked to prevent it from travelling back to injection locations.

SUMMARY OF INVENTION

One objective of the present invention is to reduce or eliminate flame reverse flow and particularly when using hydrogen as part of the fuel mixture. Another objective is to stabilize flame location within the combustor. Another objective is to improve combustion dynamics and reduce pressure fluctuations in the combustor and neighbouring engine architecture. Another objective is to reduce emissions such as nitrous oxides and sulphur oxides. Another objective is to improve the life of components such as a pilot surface by positioning the combustion flames further downstream.

For these and other objectives and advantages there is provided a combustor for a gas turbine engine, the combustor comprising a central axis about which is arranged in flow sequence a radial swirler, a pre-chamber partly defined by a wall and a combustion chamber. The radial swirler comprises a base plate having an annular array of vanes and fuel injectors arranged to direct an air/fuel mixture radially inwardly and tangentially to create a vortex that flows through the pre-chamber and into the combustion chamber.

The pre-chamber has a portion which is convergent in a downstream direction. The convergent portion of the pre-chamber can be convergent from its inlet to its outlet. Alternatively, the pre-chamber can have a portion or portions that are not convergent and which can be located either upstream and/or downstream of the convergent portion of the pre-chamber.

The pre-chamber and particularly the convergent portion may be generally frustro-conical in shape.

The pre-chamber may have straight walls in an axial aspect. Alternatively, the pre-chamber may have curved walls in the axial aspect.

The pre-chamber has an inlet area and an outlet area and the ratio of the inlet area to the outlet area may be between 1.45 and 1.70.

The pre-chamber has an axial length and an effective inlet diameter, the axial length to effective inlet diameter ratio may be between 0.45 and 0.55.

The convergent portion may extend over the entire axial length of the pre-chamber.

The rate of change of area of the convergent portion of the pre-chamber may be variable.

The rate of change of area of the convergent portion of the pre-chamber may be constant.

The pre-chamber may have at least a first portion and a second portion arranged in downstream flow sequence between the inlet and the outlet, the rate of change of area increases over the first portion and decreases over the second portion.

The first portion may extend greater than 0.5 the overall length of the pre-chamber from the inlet of the pre-chamber.

The pre-chamber may have a third portion downstream of the second portion, the third portion is parallel or divergent.

The air/fuel vortex may have a swirl number between 0.3 and 0.8.

The swirl number may be between 0.3 and 0.5.

The fuel comprises a mixture having a hydrogen content. The hydrogen content is at least 5% by volume of the fuel. The hydrogen content may be up to 80% by volume of the fuel. The hydrogen content may be in the range 5-40% by volume of the fuel.

BRIEF DESCRIPTION OF THE DRAWINGS

The above mentioned attributes and other features and advantages of this invention and the manner of attaining them will become more apparent and the invention itself will be better understood by reference to the following description of embodiments of the invention taken in conjunction with the accompanying drawings, wherein.

DETAILED DESCRIPTION OF INVENTION

Figure 1:
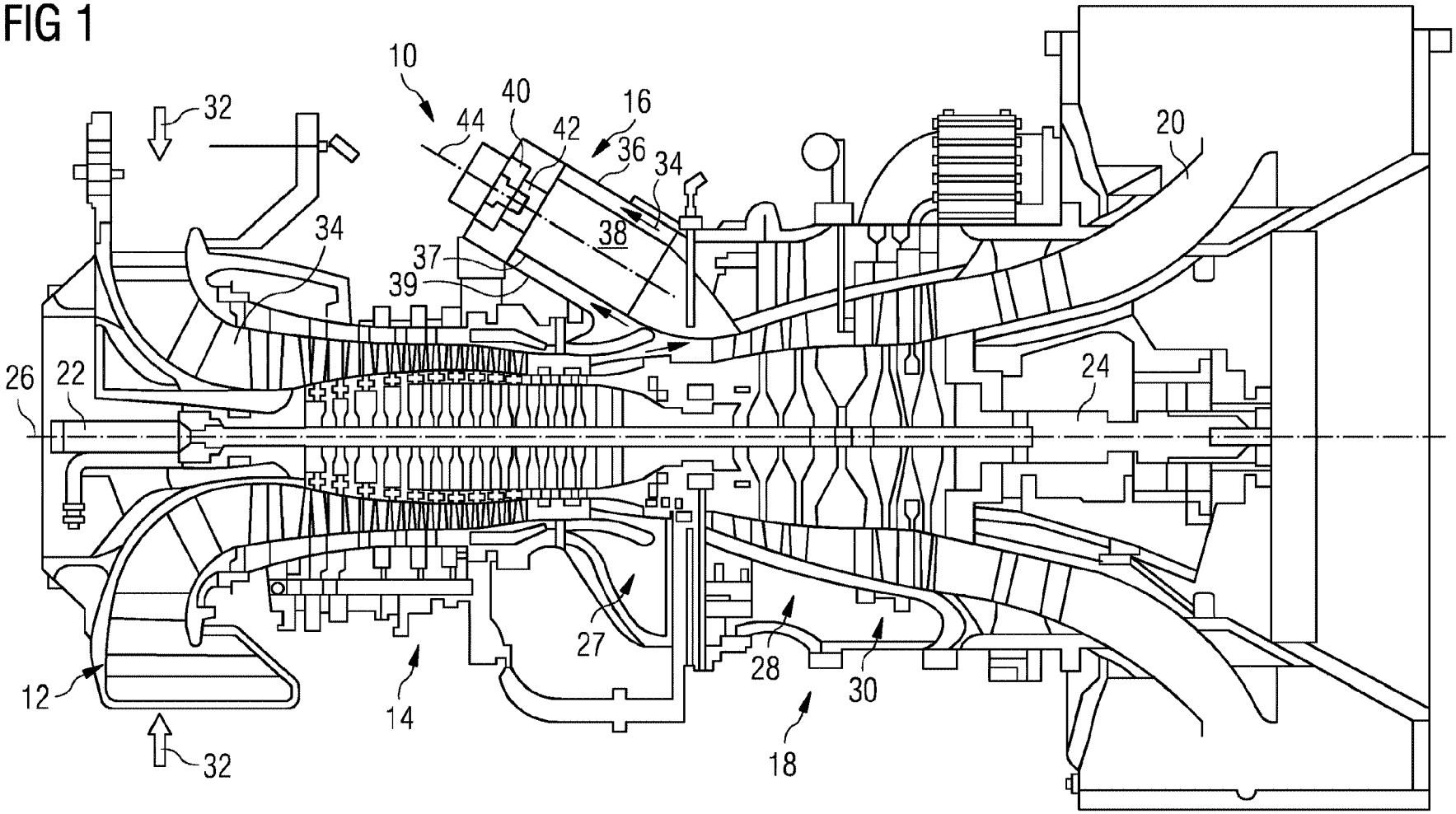
FIG. 1 shows part of a turbine engine in a sectional view and in which the present combustor arrangement is incorporated.

FIG. 1 is a schematic illustration of a general arrangement of a turbine engine 10 having an inlet 12, a compressor 14, a combustor system 16, a turbine system 18, an exhaust duct 20 and a twin-shaft arrangement 22, 24. The turbine engine 10 is generally arranged about an axis 26 which for rotating components is their rotational axis. The shafts of the twin-shaft arrangement 22, 24 may have the same or opposite directions of rotation. The combustor system 16 comprises an annular array of combustor units 36, only one of which is shown. In one example, there are six combustor units evenly spaced about the engine. The turbine system 18 includes a high-pressure turbine 28 drivingly connected to the compressor 14 by a first shaft 22 of the twin-shaft arrangement. The turbine system 18 also includes a low-pressure turbine 30 drivingly connected to a load (not shown) via a second shaft 24 of the twin-shaft arrangement.

The terms radial, circumferential and axial are with respect to the engine's rotational axis 26 or as otherwise stated. The terms upstream and downstream are with respect to the general direction of gas flow through the engine and as seen in FIG. 1 is generally from left to right.

The compressor 14 comprises an axial series of stator vanes and rotor blades mounted in a conventional manner. The stator or compressor vanes may be fixed or have variable geometry to improve the airflow onto the downstream rotor or compressor blades. Each turbine 28, 30 comprises an axial series of stator vanes and rotor blades. The stator vanes can be mounted to a radially outer casing or a radially inner drum. The rotor blades are mounted via rotor discs arranged and operating in a conventional manner. A rotor assembly comprises an annular array of rotor blades or blades and the rotor disc.

Each combustor unit 36 is constructed from two walls, an inner wall 37 and an outer wall 39, between which is defined a generally annular space. At the head of the combustor unit 36 is a swirler 40 which comprises a swirl plate and fuel injection points as will be described in more detail later. The swirler 40 is succeeded by a pre-chamber 42 and then a main combustion chamber 38. These combustor unit 36 components are generally arranged about a combustor central axis 44.

In operation air 32 is drawn into the engine 10 through the inlet 12 and into the compressor 14 where the successive stages of vanes and blades compress the air before delivering the compressed air 34 into the combustor system 16. The compressed air 34 flows between the inner and outer walls 37, 39 and into the swirler 40. The swirler 40 creates highly turbulent air into which the fuel is injected. The air/fuel mixture is delivered into the pre-chamber 42 and then into the main combustion chamber 38. In the combustion chamber 38 of the combustion unit 16 the mixture of compressed air and fuel is ignited. The resultant hot working gas flow is directed into, expands and drives the high-pressure turbine 28 which in turn drives the compressor 14 via the first shaft 22. After passing through the high-pressure turbine 28, the hot working gas flow is directed into the low-pressure turbine 30 which drives the load via the second shaft 24.

The low-pressure turbine 30 can also be referred to as a power turbine and the second shaft 24 can also be referred to as a power shaft. The load is typically an electrical machine for generating electricity or a mechanical machine such as a pump or a process compressor. Other known loads may be driven via the low-pressure turbine. The fuel may be in gaseous and/or liquid form.

The turbine engine 10 shown and described with reference to FIG. 1 is just one example of a number of engines or turbomachinery in which this invention can be incorporated. Such engines can be gas turbines or steam turbine and include single, double and triple shaft engines applied in marine, industrial and aerospace sectors.

Figure 2:
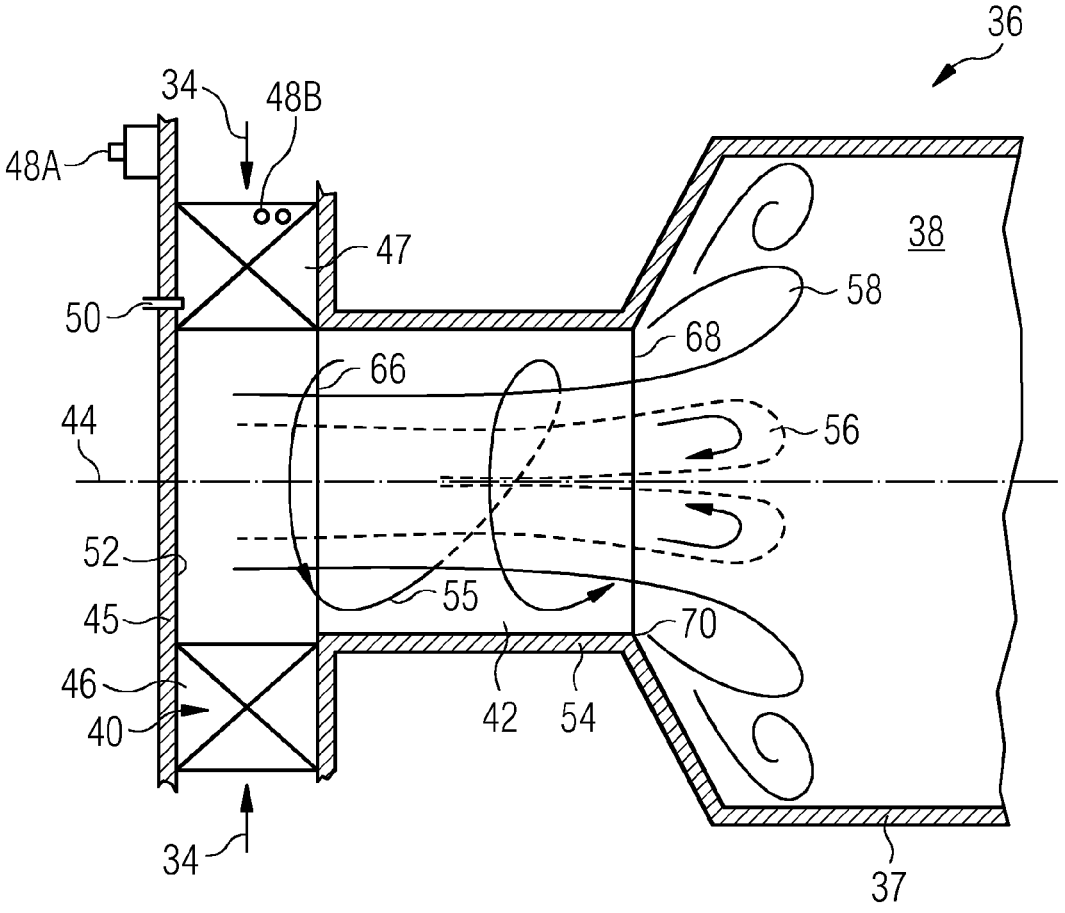
FIG 2 RELATED ART
FIG. 2 is a schematic cross-section through a known combustor.

FIG. 2 is a cross-section through part of a known combustor unit 36 of a turbine engine 10. The swirler 40 comprises an annular array of vanes 46 which are angled relative to the combustor axis 44 to impart a swirling flow 55 of mixing air and fuel as is well known. The swirling flow 55 rotates about the combustor axis 44 and flows in a general left to right direction as seen in FIG. 2 (and later FIG. 3). The vanes 46 form an array of mixing channels 47 between each vane 46. The swirler 44 further comprises main fuel injectors 48A, 48B and pilot fuel injectors 50. The swirler 40 has a pilot surface 52 which faces the pre-chamber 42 and bounds the pre-chamber's upstream axial extent. The pre-chamber 42 is further defined by an annular wall 54 which has parallel sides. The pre-chamber 42 has an inlet 66 and an outlet 68. The outlet 68 forms or is at a lip 70 of the pre-chamber 42 and where the pre-chamber 42 terminates. The pre-chamber 42 walls 54 are then succeeded by the wall(s) 37 of the main combustion chamber 38. From the lip 70 the wall 37 is divergent and opens to the main combustion chamber 38 which has a greater cross-sectional area than that of the pre-chamber 42.

There can be two distinct fuel/air mixtures and subsequently combustion flames in the combustion chamber 38; a pilot flame 56 is derived from the pilot fuel supply 50 and the main flame 58 is derived from the main fuel supply 48A, 48B. The pilot and main flames are distinct from one another because of the location of the respective fuel injection points into the air flow in or near to the mixing channel(s) 47. The main fuel injectors 48A, 48B inject fuel into the mixing channel further away from the pilot surface 52 than the pilot fuel injector(s) 50. Thus the respective fuel/air mixtures form substantially different flame regions with the pilot flame 56 generally radially inward of the main flame 58.

Radial swirlers, as in the case here, have or can be defined as having, a swirl number SN. The Swirl number can be calculated as is well known in the art, suffice to say here, that the swirl number can be defined by a relationship between the fluxes of angular and linear momentum of the fuel/air mixture. That is to say the angular momentum relates to rotational velocity about the combustor axis 44 and the linear moment is relates to the velocity in the axial direction along the combustor axis 44. Thus the SN is defined herein as the ratio of tangential momentum to axial momentum of the fluid or fuel/air mixture.

The general schematic cross section of FIG. 2 shows a Dry Low Emissions (DLE) combustor 36. The known swirler 40 described above has a SN in the region 0.5 to 0.8. This combustor provides a good DLE burner for combusting methane, medium and high calorific value fuels (MCV and HCV fuels respectively) containing higher hydrocarbons. However, the current design is not suitable for burning fuel with hydrogen content mainly due to dominance of flame speed on the flow characteristics. The presence of hydrogen increases flame speed and causes flash-back into the pre-chamber 42. This is clearly detrimental and undesirable and can cause extinction of the flame and increased emissions of nitrous oxides, sulphur oxides and unburned hydrocarbons amongst other undesirable combustion by products.

Figure 3:
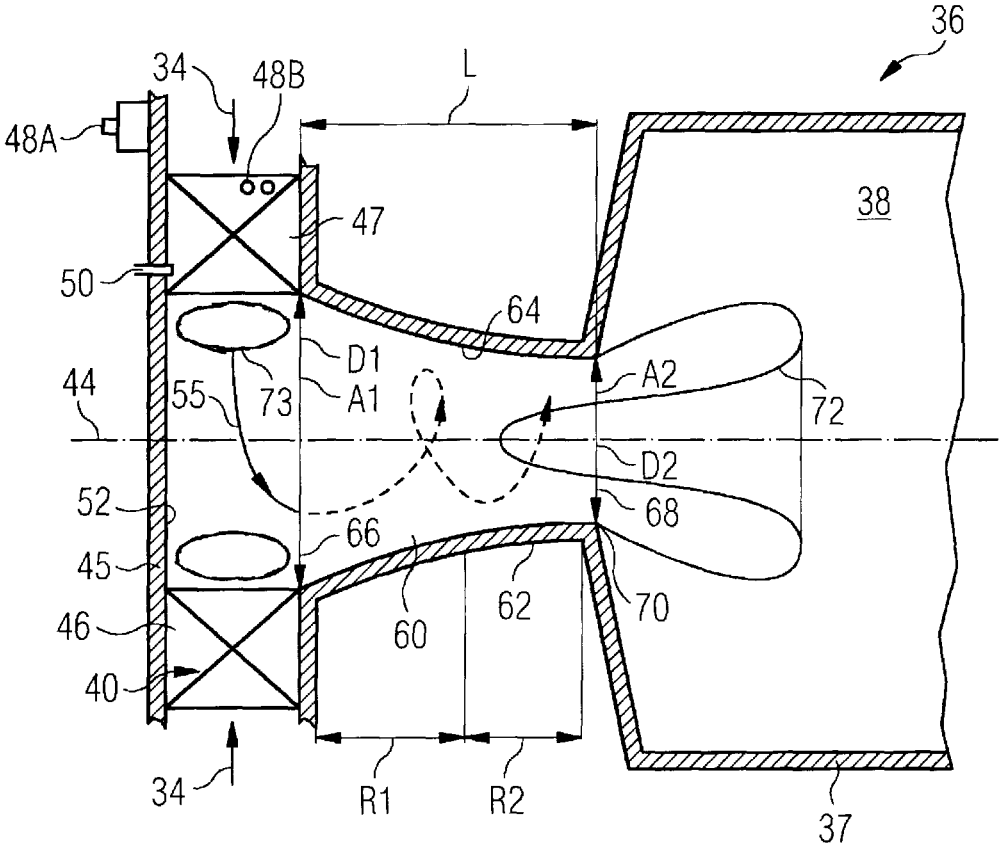
FIG. 3 is a schematic cross-section through a first embodiment of the present combustor and pre-chamber and which may be incorporated into the turbine engine shown and described with reference to FIG. 1.

Reference is now made to FIG. 3 which is a similar view to FIG. 2 and where alike features have the same reference numerals and function in a similar manner except where described otherwise. Here the combustor unit 36 incorporates a pre-chamber 60 that is defined by an annular wall 62. The annular wall 62 has generally converging sides and therefore a converging internal surface 64 in the downstream direction. Thus the cross-sectional area of the pre-chamber 60 generally decreases between the inlet 66 and the outlet 68. In the pre-chamber's 60 basic form it has at least a portion where the annular wall 62 is convergent in a downstream direction with respect to the general flow direction of the swirling flow 55. The pre-chamber 60 has an axial length L defined from the inlet 66 to the outlet 68. In this exemplary embodiment the pre-chamber 60 is convergent from the inlet to the outlet, but in other examples as described below only a portion of the pre-chamber 60 is convergent. The inlet 66 or the upstream end of the convergent portion has an area A1 and the outlet 68 or downstream end of the convergent portion has an area A2. In this example, the inlet 66 is the upstream end of the convergent portion and the outlet 68 is the downstream end of the convergent portion. Further, in this example, the inlet 66 and outlet 68 are generally circular and have respective diameters D1 and D2 although the inlet and/or outlet do not need to be circular. Where the inlet and/or outlet are non-circular the term diameter can be apportioned to an equivalent diameter for an equivalent circular area of the inlet 66 or outlet 68.

This convergent pre-chamber 60 is designed to prevent flash-back of fuel with a high flame speed and specifically for fuel including a gas such as hydrogen that has a high combustion flame speed. Flame speed and particularly flash-back can occur when the velocity of fuel/air mixture flow is less than the burning velocity of the flame and in this case the location of the flame can move upstream or in the direction right to left in the figures. It is desirable and an object of the present pre-chamber 60 design for the flame to remain stable and in one position at least in the axial sense. The likelihood of the flash-back phenomenon increases with percentage of hydrogen content in the fuel. Flash-back can be caused in a fuel having as little as 1% by volume of hydrogen, but is most likely to be caused where the fuel has a content of 5% or greater by volume of hydrogen.

The present convergent pre-chamber 60 can be designed to accommodate fuels with any hydrogen content. Indeed the convergent pre-chamber 60 is capable operating fuels with no hydrogen or only trace amounts of hydrogen. In general, the greater the percentage of hydrogen in the fuel the greater the desired rate of convergency required for the convergent pre-chamber. However, for any one design the convergent pre-chamber 60 can be used for use with fuel having up to 80% by volume hydrogen. One particularly suitable range of hydrogen content in fuels is 5-40% by volume.

With the convergent pre-chamber 60 a stabilised flame shape of the main combustion flame 72 and is believed to be produced as shown in FIG. 3. The pilot flame 73 is shown as a dashed line. The main combustion flame shape 72 is shown with respect to the heat release or source of reaction location. This is the main flame shape 72 where the fuel includes a small percentage of hydrogen, for example 5% by volume. As the main fuel/air mixture passes through the pre-chamber 60 the main flame 72 attaches in part to the lip 70 or at least very close to the lip 70. The heat release location or boundary of the main flame 72 then extends downstream into the main chamber 38 and forms a generally hollow cone shape 72. This main flame shape 72 is created by the air/fuel mixture flowing with a higher velocity near the surface 64 of the convergent pre-chamber 60 than near the centre or along the axis 44. The bulk air/fuel mixture is accelerated by virtue of the decreasing cross-sectional area, but at a greater rate of acceleration near the surface 64 compared to the air/fuel mixture near the centre line or axis 44. As the air/fuel mixture enters the main combustion chamber 38 the higher velocity and radially outer part wraps radially inwardly and recirculates backwards or towards the pre-chamber 60 and axis 44 with a strong central recirculation zone.

Although the convergent pre-chamber 60 causes the air/fuel mixture to have a net acceleration between its inlet 66 and outlet 68, the overall time the air/fuel mixture is in the pre-chamber 60 can be approximately the same as the FIG. 2 example by virtue of a greater area of the FIG. 3 inlet 66 than the FIG. 2 inlet 66. Thus the outlet 68 or at least the end of the convergent portion of the pre-chamber 60 has an outlet 68 having a smaller area than the FIG. 2 example. Thus where the convergent pre-chamber 60 has the same or approximately the same axial length as the FIG. 2 example the residence time of the air/fuel mixture in the pre-chamber is approximately the same. Thus the fuel/air mixture in the pre-chamber 60 can have a greater axial velocity at the outlet 68 than the known pre-chamber 42.

The convergent pre-chamber 60 therefore prevents flash-back of the combustion flame, particularly when using fuel with hydrogen, by virtue of in part an increase in the nett velocity of the air/fuel mixture and in part the increase in velocity of the outer part of the air/fuel mixture nearer the surface 64 of the pre-chamber 60.

In the exemplary embodiment as shown in FIG. 3 the pre-chamber 60 is a general frusto-conical shape and specifically the wall(s) 62 of the pre-chamber 60 are curved in the axial aspect as shown in the section. The curvature of the wall 62 is constant such that the rate of change of an angle between a tangent and the axis 44, at points along the wall, is constant. Thus the rate of change of cross-sectional area of the pre-chamber is not constant and decreases between the inlet 66 and the outlet 68 and in this example from the inlet to the outlet 68. At the outlet 68 the tangent is parallel to the combustor axis 44, but does not need to be so in other examples.

Figure 4:
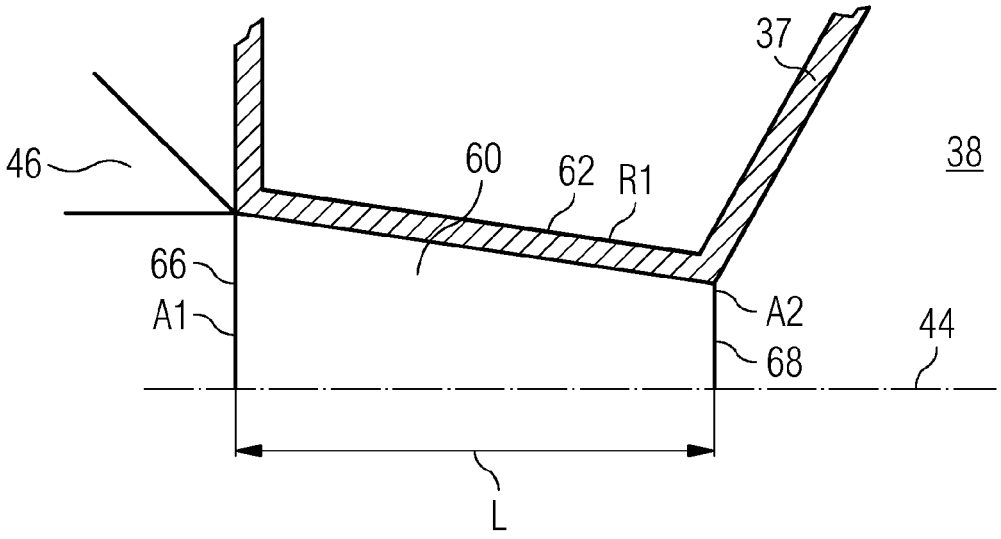
FIG. 4 is a part schematic cross-section through the combustor and pre-chamber showing a second embodiment and FIG. 5 is a part schematic cross-section through the combustor and pre-chamber showing a third embodiment.

FIG. 4 shows an alternative embodiment where part of the pre-chamber 60 has straight walls 62 in an axial aspect and when viewed in the cross-section. Thus the rate of change of the cross-sectional or fuel/air mixture flow area between the inlet 66 and the outlet 68 is constant. For this straight walled convergent pre-chamber 60 recirculation of the fuel/air mixture is largely avoided and hence flash back of the flame on the pre-chamber wall.

Referring back to FIG. 3 the pre-chamber 60 has at least a first portion R1 and a second portion R2 arranged in downstream flow sequence between the inlet 66 and the outlet 68. The rate of change of area increases over the first portion R1 and the rate of change decreases over the second portion R2. This arrangement provides a particularly smooth transition for the air/fuel mixture passing through the pre-chamber 60 when considering the percentage change in the decreasing area at any two points when moving axially towards the outlet 68. In other words the rate of change of area decreases, however, as a percentage the rate of change can remain constant considering the area of the pre-chamber 60 is diminishing towards the outlet 88. Further, this arrangement can create a throat in the pre-chamber 60. The distance of the throat from the pre-chamber's inlet 66 is greater than 0.5 times the length L of the pre-chamber 60 to produce the desired effect of preventing flash-back. The flame speed of hydrogen is very sensitive with the distance from which the flame can propagate back to swirler vanes to flashback. Therefore, placing the flame anything less than 0.5 L could result in a partial flashback compared to the known pre-chamber design. Thus the downstream end of the first portion R1 extends greater than 0.5 L from the inlet 66.

Figure 5:
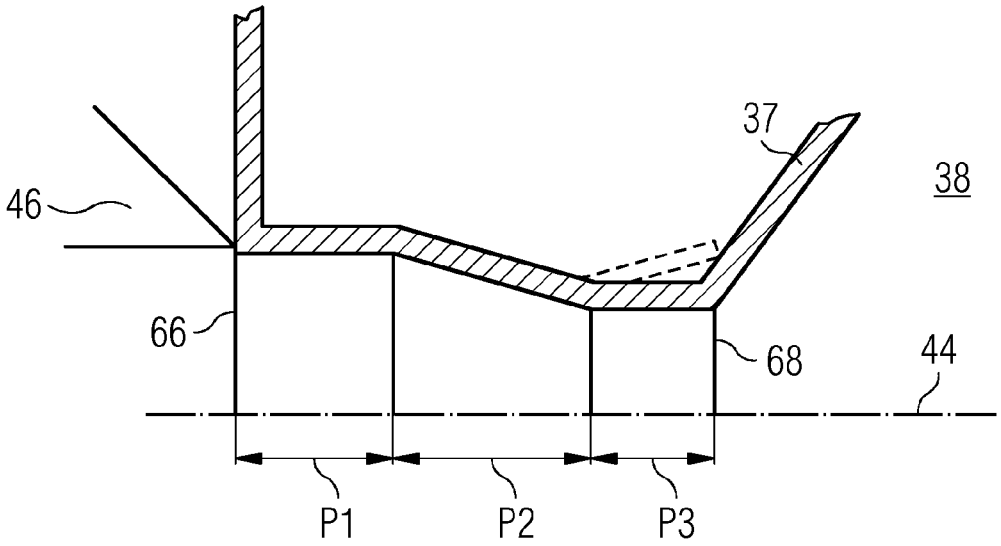

Referring to FIG. 5 and a third embodiment where only a portion of the pre-chamber's axial length has a converging portion P2. The pre-chamber 60 is formed by a first portion P1, a second and the converging portion P2 and a third portion P3 located downstream of the second portion P2. The first portion P1 is located upstream of the convergent portion P2. The first portion P1 has a generally constant cross-section and therefore is essentially cylindrical or circular in cross-section. The third portion P3 also has a generally constant cross-section and therefore is essentially cylindrical or circular in cross-section. The third portion P3 has a smaller cross-section than the first portion P1. The pre-chamber 60 transitions from the first portion P1 to the third portion P3 by virtue of the convergent portion P2. In a modification of this embodiment, the third portion P3 may be divergent as shown by the dashed lines and as such the pre-chamber 60 forms a convergent-divergent flow passage. The divergent third portion P3 can assist in smoothly exhausting the fuel/air mixture helping to create a particularly stable combustion flame. The intention of the parallel or diverging portion P3 at the end of the pre-chamber's converging portion P2 to principally diffuse the air/fuel mixture flow into the combustion expansion chamber 38 without a sudden expansion which can enhance in flame flashback on to the pre-chamber wall 62. The length of the parallel or diverging portion P3 is less than the converging portion P2 in order to have the desired effect of burning hydrogen in the fuel.

For all the embodiments shown and described herein the ration of the inlet area A1 to the exit area A2 is between and includes 1.45 and 1.70. This ratio ensures that the convergence of the pre-chamber and therefore the aerodynamics of the air/fuel mixture is sufficient to prevent flash-back of the flame yet not too severe to cause the flame to be located too far downstream of the lip 70.

The ratio of the effective inlet diameter D1 and the axial length L of the pre-chamber 60 should be between and including 0.45 and 0.55. The optimum ratio is always 0.5, but in order to burn hydrogen rich fuels with the present convergent pre-chamber, the ratio can be as low as 0.45 to be effective. Any lower than 0.45 would result in a large pre-chamber tube with a small diameter which will impose undesirable pressure losses. A D/L ratio greater than 0.55 should have no or minimal effect of convergence of pre-chamber.

The examples and parameters defined above are specific to a combustor unit 36 configured to have a swirl number between 0.3 and 0.8 and particularly between 0.3 and 0.5. The lower swirl number burners or combustors help to reduce the tangential component of the central fuel/air mixture vortex 55 at the exit of the combustor.

It should be appreciated that although the figures show the pre-chamber 60 to be arranged symmetrically about the combustor axis 44, the convergent portion may be non-symmetrical either in terms of its cross-sectional shape or the angle of the walls 62 to the axis 44. For example, the sectional cut through wall 62 shown in FIG. 4 is angled radially inwardly and at the axis 44, however, the opposing sectional cut through of wall 62 may be parallel or at a different angle relative to the axis 44.

The invention claimed is:

1. A combustor for a gas turbine engine, the combustor comprising:

a central axis about which are arranged in an upstream to downstream flow sequence a radial swirler, a pre-chamber partly defined by a wall and a combustion chamber, wherein the radial swirler comprises a base plate having an annular array of vanes and fuel injectors arranged to deliver an air/fuel mixture radially inwardly and tangentially to an inlet of the pre-chamber to create a vortex that flows through the pre-chamber to an outlet of the pre-chamber and then into the combustion chamber, wherein a fuel comprises a mixture having a hydrogen gas content, wherein the hydrogen gas content is at least 5% by volume of the fuel, wherein the base plate comprises a pilot surface which faces the pre-chamber and bounds an upstream axial extent of the pre-chamber, wherein the pre-chamber has a portion which is convergent in a downstream direction and is configured to accelerate the air/fuel mixture to a velocity effective to prevent flashback of a flame from the combustion chamber into the radial swirler, and wherein the pre-chamber has an inlet area and an outlet area and a ratio of the inlet area to the outlet area is between 1.45 and 1.70.

2. The combustor as claimed in claim 1, wherein the pre-chamber is generally frustro-conical.

3. The combustor as claimed in claim 1, wherein the pre-chamber has straight walls in an axial aspect.

4. The combustor as claimed in claim 1, wherein the pre-chamber has curved walls in an axial aspect.

5. The combustor as claimed in claim 1, wherein the pre-chamber has an axial length (L) and an effective inlet diameter (D), a ratio of the axial length to effective inlet diameter is between 0.45 and 0.55.

6. The combustor as claimed in claim 1, wherein the portion extends over an entire axial length of the pre-chamber.

7. The combustor as claimed in claim 5, wherein a rate of change of area of the portion of the pre-chamber is variable.

8. The combustor as claimed in claim 5, wherein the rate of change of area of the convergent portion of the pre-chamber is constant.

9. The combustor as claimed in claim 5, wherein the pre-chamber has at least a first portion and a second portion arranged in downstream flow sequence between the inlet and the outlet, the rate of change of area increases over the first portion and decreases over the second portion.

10. The combustor as claimed in claim 9, wherein the first portion extends greater than 0.5 L from the inlet of the pre-chamber.

11. The combustor as claimed in claim 9, wherein the pre-chamber has a third portion downstream of the second portion, the third portion is parallel or divergent.

12. The combustor as claimed in claim 1, wherein the vortex has a swirl number between 0.3 and 0.8.

13. The combustor as claimed in claim 12,
wherein the swirl number is between 0.3 and 0.5.

14. The combustor as claimed in claim 1,
wherein the hydrogen gas content is up to 80% by volume.

15. The combustor as claimed in claim 1,
wherein the hydrogen gas content is in a range of 5-40% by volume.

* * * * *